US008884783B2

(12) United States Patent
Roberts et al.

(10) Patent No.: US 8,884,783 B2
(45) Date of Patent: Nov. 11, 2014

(54) SYSTEMS AND METHOD FOR CONTROLLING PREEMPTION OF A TRAFFIC SIGNAL

(75) Inventors: Douglas Gordon Roberts, Richmond (CA); Jerry Lee Johnson, Cottage Grove, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 721 days.

(21) Appl. No.: 13/034,211

(22) Filed: Feb. 24, 2011

(65) Prior Publication Data

US 2012/0218126 A1 Aug. 30, 2012

(51) Int. Cl.
*G08G 1/07* (2006.01)
*G08G 1/087* (2006.01)

(52) U.S. Cl.
CPC ..... *G08G 1/087* (2013.01)
USPC ..... 340/906; 340/902; 340/904; 340/924; 340/994; 340/995.17

(58) Field of Classification Search
USPC ..... 340/902, 904, 924, 994, 995.17
See application file for complete search history.

(56) References Cited

U.S. PATENT DOCUMENTS

| | | | | |
|---|---|---|---|---|
| 5,187,476 | A | 2/1993 | Hamer | |
| 5,202,683 | A | 4/1993 | Hamer et al. | |
| 5,539,398 | A | 7/1996 | Hall et al. | |
| 5,602,739 | A | 2/1997 | Haagenstad et al. | |
| 5,986,575 | A | 11/1999 | Jones et al. | |
| 6,064,319 | A | 5/2000 | Matta | |
| 6,621,420 | B1 | 9/2003 | Poursartip | |
| 6,909,380 | B2 * | 6/2005 | Brooke | 340/906 |
| 6,985,090 | B2 | 1/2006 | Ebner et al. | |
| 7,307,547 | B2 | 12/2007 | Schwartz | |
| 7,333,028 | B2 | 2/2008 | Schwartz | |
| 7,417,560 | B2 | 8/2008 | Schwartz | |
| 7,515,064 | B2 | 4/2009 | Schwartz | |
| 7,573,399 | B2 | 8/2009 | Schwartz | |
| 8,054,202 | B1 * | 11/2011 | Sikora et al. | 340/906 |

(Continued)

FOREIGN PATENT DOCUMENTS

| | | |
|---|---|---|
| DE | 44 12 528 | 10/1995 |
| DE | 198 42 912 | 3/2000 |
| WO | 2005/094544 | 10/2005 |

OTHER PUBLICATIONS

U.S. Appl. No. 12/684,442, filed Jan. 8, 2010, Eichhorst.

*Primary Examiner* — Daryl Pope
(74) *Attorney, Agent, or Firm* — Crawford Maunu PLLC

(57) ABSTRACT

A priority control unit is provided for use with light-based and GPS-based traffic control priority systems. The priority control unit includes a light emitter subsystem that is configured to emit pulses of light. The pulses of light encode a priority request for activating preemption of a traffic signal by a light-based traffic control priority system. The priority control unit also includes a GPS-based subsystem that is configured to transmit a priority request by radio waves. The priority request from the GPS-based subsystem is for activating preemption of a traffic signal by a GPS-based traffic control priority system. A switch is coupled to the light emitter subsystem and to the GPS-based subsystem. The switch simultaneously activates both the light emitter subsystem and the GPS-based subsystem for transmitting priority requests in response to user control. In another embodiment, the priority control unit further includes a broadcast based subsystem for transmitting priority requests.

15 Claims, 4 Drawing Sheets

(56) References Cited

U.S. PATENT DOCUMENTS 8,373,578 B1 * 2/2013 Sikora et al. ..... 340/906
2004/0008126 A1 * 1/2004 Diba et al. ..... 340/907
2005/0264431 A1 12/2005 Bachelder
2007/0008174 A1 * 1/2007 Schwartz ..... 340/902

* cited by examiner

SYSTEMS AND METHOD FOR CONTROLLING PREEMPTION OF A TRAFFIC SIGNAL

FIELD OF THE INVENTION

The present invention is generally directed to generating preemption requests for traffic control signals.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® infrared system. This system utilizes a high power strobe tube (emitter), which is located in or on the vehicle that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light. The receiver at the intersection may also be referred to herein as a light emitter-based intersection module.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it. An example light emitter-based system is described in U.S. Pat. No. 5,202,683 to Hamer et al.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle is used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected in a first come, first served manner. A preemption request is issued to the controller for the approach direction with the highest priority vehicle travelling on it. An example GPS-based intersection module is described in U.S. Pat. No. 5,539,398 to Hall et al., the contents of which is incorporated herein by reference.

With metropolitan wide networks becoming more prevalent, additional means for detecting vehicles via wired networks such as Ethernet or fiber optics and wireless networks such as Mesh or 802.11b/g may be available. With network connectivity to the intersection, vehicle tracking information may be delivered to the intersection over a network medium. In this instance, the vehicle location is either broadcast by the vehicle itself over the network or it may broadcast by an intermediary gateway on the network that bridges between, for example, a wireless medium used by the vehicle and a wired network on which the intersection electronics resides. In this case, the vehicle or an intermediary, such as a centralized control system, reports via the network, the vehicle's security information, location, speed and heading along with the current time to intersections on the network. Centrally-controlled intersection modules receive the vehicle information and evaluate the position using approach maps as described in the Opticom GPS system. The security coding could be identical to the Opticom GPS system or employ another coding scheme.

SUMMARY

In one embodiment, a priority control unit is provided for use with light-based and GPS-based traffic control priority systems. The light-based traffic control priority system activates preemption of a traffic signal in response to pulses of light encoding a priority request, and the GPS-based traffic control priority system activates preemption of a traffic signal in response to a radio signal encoding a priority request. The priority control unit includes a light emitter subsystem that is configured to emit pulses of light. The pulses of light encode a priority request for activating preemption of a traffic signal by the light-based traffic control priority system. The priority control unit also includes a GPS-based subsystem that is configured to transmit a priority request by radio waves. The priority request from the GPS-based subsystem is for activating preemption of a traffic signal by the GPS-based traffic control priority system. A switch is coupled to the light emitter subsystem and to the GPS-based subsystem. The switch simultaneously activates both the light emitter subsystem and the GPS-based subsystem for transmitting priority requests in response to user control.

In another embodiment, a method is provided for generating priority requests to light-based and GPS-based traffic control priority systems. The light-based traffic control priority system activates preemption of a traffic signal in response to pulses of light encoding a priority request, and the GPS-based traffic control priority system activates preemption of a traffic signal in response to a radio signal encoding a priority request. The method includes simultaneously activating both a light emitter subsystem and a GPS-based subsystem in response to a single user control. Pulses of light are emitted by the light emitter subsystem. The pulses of light encode a priority request for activating preemption of a traffic signal by the light-based traffic control priority system. A priority request is transmitted via radio waves by the GPS-based subsystem. The priority request from the GPS-based system is for activating preemption of a traffic signal by the GPS-based traffic control priority system.

A system for generating priority requests to light-based and GPS-based traffic control priority systems is provided in another embodiment. The light-based traffic control priority system activates preemption of a traffic signal in response to pulses of light encoding a priority request, and the GPS-based traffic control priority system activates preemption of a traffic signal in response to a radio signal encoding a priority request. The system includes means for simultaneously activating both a light emitter subsystem and a GPS-based subsystem in response to a single user control. Means are included for emitting pulses of light by the light emitter subsystem. The pulses of light encode a priority request for activating preemption of a traffic signal by the light-based traffic control priority system. Means are included for transmitting a priority request via radio waves by the GPS-based subsystem. The priority request from the GPS-based subsystem is for activating preemption of a traffic signal by the GPS-based traffic control priority system.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

Figure 1:
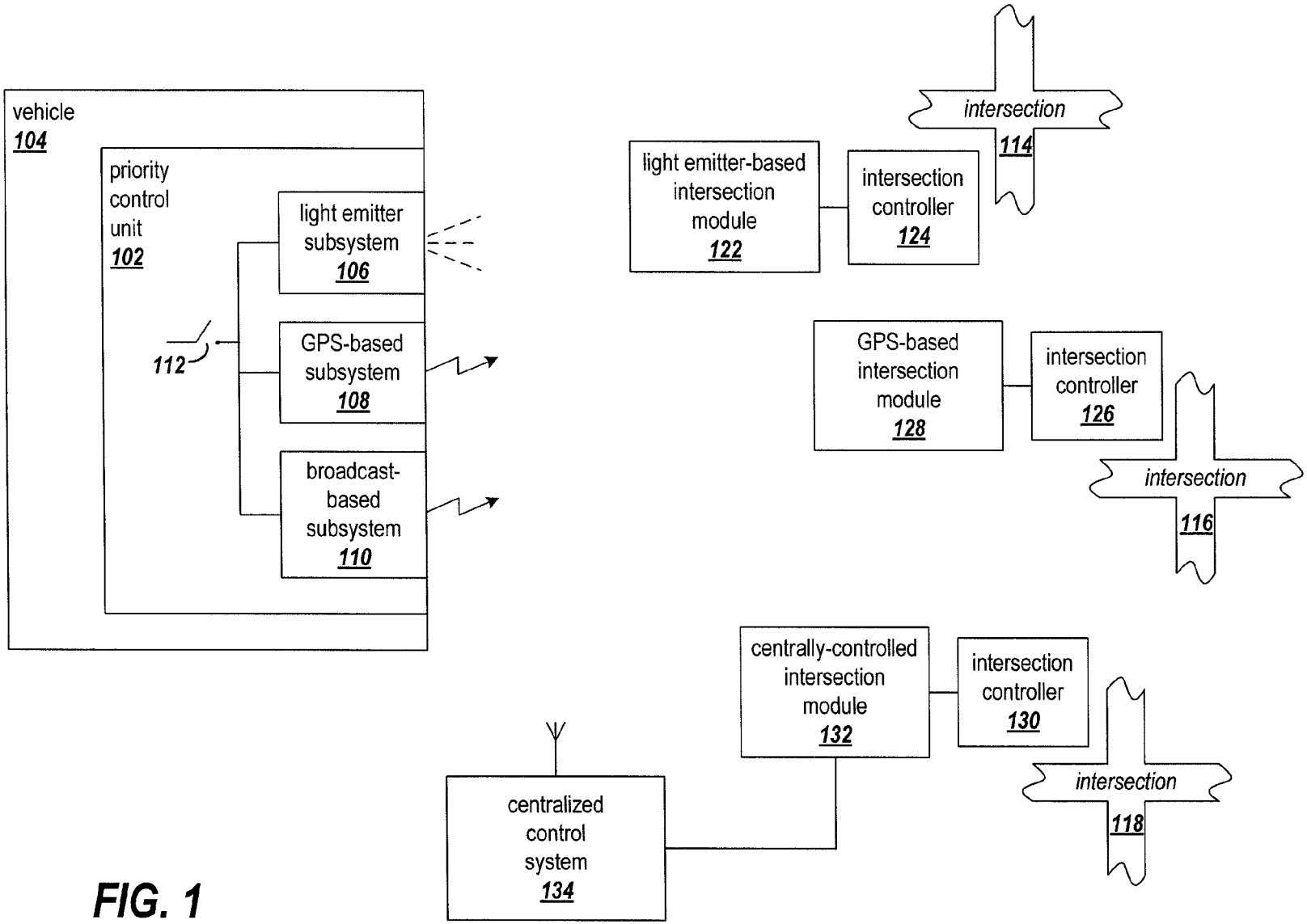
FIG. 1 is a functional block diagram of a system in which a priority control unit controls multiple types of intersection control modules, including light emitter-based intersection modules, GPS-based intersection modules, and centrally-controlled intersection modules.

This figure shows a particular example embodiment of the light-emitter portion of the priority control arrangement.

DETAILED DESCRIPTION

The embodiments of the present invention issue simultaneous traffic signal preemption requests via different transmission channels. For example, preemption requests may be transmitted via a combination of an IR light emitter, via a radio wave signal in a GPS-based system, and/or via a wired or wireless network. Preemption requests may be alternatively referred to as priority requests, and such terms may be used interchangeably herein. The ability to transmit requests via multiple types of systems supports mutual aid environments and also mitigates the costs of upgrading systems from one technology to another.

Neighboring municipalities often arrange to provide mutual aid in emergency situations. However, in some instances the neighboring municipalities may employ different preemption control systems, which would not allow emergency vehicles in one municipality to preempt a traffic signal in a neighboring municipality. For example, preemption requests from a vehicle equipped with an IR light emitter-based unit would not be recognized by a GPS-based intersection controller. With embodiments of the present invention, selected vehicles may be deployed with priority control units that issue preemption requests using a combination of channels. Thus, mutual aid may be enhanced without having to install the same type of system at all intersections.

The embodiments of the present invention also provide a cost-effective way to upgrade an existing IR emitter-based preemption system to newer technologies, such as GPS-based systems and network-based systems. Instead of having to upgrade every intersection, for example, IR detectors may be left in place at selected intersections, while other intersections may be upgraded. Vehicles in the fleet may be upgraded with a priority control unit that transmits preemption requests in multiple channels.

In one embodiment, a priority control unit is operable to simultaneously transmit priority requests via multiple channels. For example, the priority control unit may be used with light-based and GPS-based traffic control priority systems. In a light-based traffic control priority system, preemption of a traffic signal is activated in response to pulses of light encoding a priority request from a vehicle. In a GPS-based traffic control priority system, preemption of a traffic signal is activated in response to a radio signal encoding a priority request that includes GPS information. A user-controlled switch is coupled to both a light emitter subsystem and to a GPS-based subsystem in the priority control unit. User operation of the switch simultaneously activates both the light emitter subsystem and the GPS-based subsystem for transmitting priority requests in response to user control. The light emitter subsystem emits pulses of light that encode a priority request for activating preemption of a traffic signal by a light-based traffic control priority system, and the GPS-based subsystem transmits a priority request by radio waves for activating preemption of a traffic signal by a GPS-based traffic control priority system. In another embodiment, a third subsystem may be included in the priority control unit for broadcasting a priority request for dissemination to intersections by a centralized system.

FIG. 1 is a functional block diagram of a system in which a priority control unit 102 controls multiple types of intersection control modules, including a light emitter-based intersection module 122, GPS-based intersection module 128, and centrally-controlled intersection module 132. The priority control unit 102 includes a light emitter subsystem 106, a GPS-based subsystem 108, and a broadcast-based subsystem 110. The subsystems 106, 108, and 110 are coupled to switch 112, which is user controllable. In one embodiment, the subsystems 106, 108, and 110 may be disposed in a single case that is mounted within vehicle 104 or on the outside of the vehicle. Suitable structures for implementing a switch to activate the subsystems 106, 108, and 110 are known in the art. For example, the switch may be the same as that used in a priority control unit that supports only one of a light emitter subsystem, GPS-based subsystem, or broadcast-based subsystem. The switch may be electro-mechanical, capacitive, or software-actuated, for example.

Three example intersections 114, 116, and 118 are shown in FIG. 1. The intersections illustrate the different types of technologies with which the priority control unit 102 is configured to communicate. The relative positions of the intersections are not intended to correspond to actual geographical locations. The intersections are shown to demonstrate that the vehicle 104 makes priority requests via different technologies so that the vehicle is not limited to preempting a traffic signal at only intersections that implement a particular technology. Rather, priority requests from the vehicle will be recognized at different intersections having different control technologies.

Intersection 114 is controlled by an intersection controller 124 that is coupled to a light emitter-based intersection module 122, intersection 116 is controlled by an intersection controller 126 that is coupled to a GPS-based intersection module 128, and intersection 118 is controlled by an intersection controller 130 that is coupled to a centrally controlled intersection module 132. Another intersection (not shown) may have a module that recognizes both light pulses and GPS-based priority requests, such as that described in patent application Ser No. 12/684,442, entitled, PRIORITIZATION OF TRAFFIC SIGNAL PREEMPTION REQUESTS RECEIVED FROM MULTIPLE SOURCES OVER DIFFERENT COMMUNICATION MEDIUMS. The Ser. No. 12/684,442 application describes an intersection control system in which circuitry at the intersection processes preemption requests received via different channels and is incorporated herein by reference. The modules 122, 128, and 132 and controllers 124, 126, and 130 and supporting structure and implementations are known in the art.

The priority control unit 102 is configured to simultaneously transmit priority requests by the light emitter subsystem 106, the GPS-based subsystem 108, and the broadcast-based subsystem 110. Regardless of the type of preemption control technology at an intersection being approached by the vehicle, the priority request will be recognized at the intersection. If the vehicle 104 is approaching intersection 114, light pulses emitted by the light emitter subsystem are detected by the light emitter-based intersection module 122 for selectively activating a preemption request with the intersection controller 124. If the vehicle is approaching intersection 116, a radio signal containing a GPS-based priority request is received by the GPS-based intersection module 128 for selectively activating a preemption request with the intersection controller 126. If the vehicle is approaching intersection 118, a broadcast signal from broadcast-based subsystem 110 will be received by a centralized control system 134, and the centralized control system routes a priority request to the centrally-controlled intersection module 132 for activating a preemption request with intersection controller 130.

Figure 2:
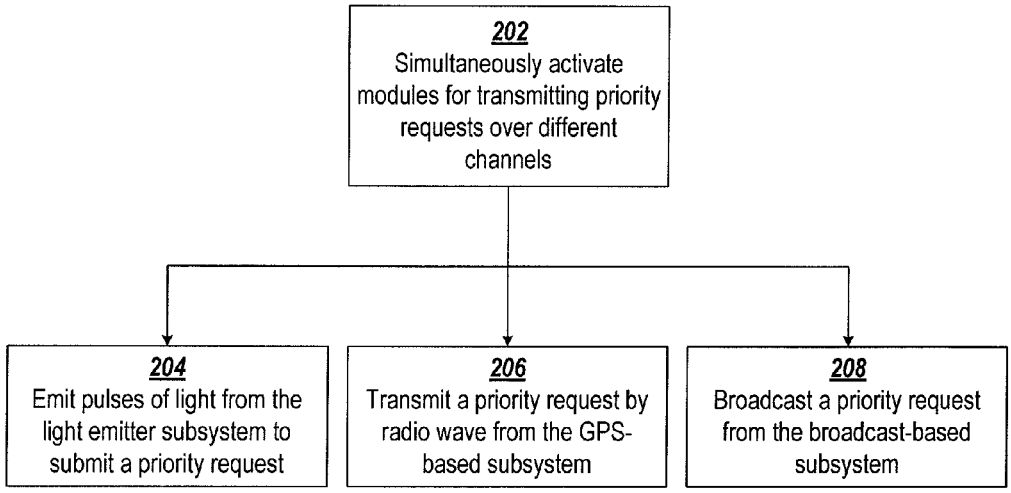
FIG. 2 is a flowchart of an example process performed by a priority control arrangement in accordance with one or more embodiments of the invention.

FIG. 2 is a flowchart of an example process performed by a priority control arrangement in accordance with one or more embodiments of the invention. The process generally entails activating multiple modules for transmitting priority requests over different channels at process block 202, and the different modules simultaneously transmitting the priority requests as shown by process blocks 204, 206, and 208.

In one embodiment, the simultaneous activation is in response to a user control. In an emergency vehicle, for example, activation of the emergency lights by the driver may also initiate the activation of the modules that generate priority requests.

In response to user activation, a combination of different priority request subsystems is activated. The combination may include a light emitter subsystem emitting light pulses with a priority request and a GPS-based subsystem generating a radio wave with a priority request, or the combination may include activation of both the light emitter subsystem and the GPS-based subsystem along with activation of the broadcast-based subsystem. Those skilled in the art will recognize that other combinations selected from the three technologies may be desirable.

Figure 3:
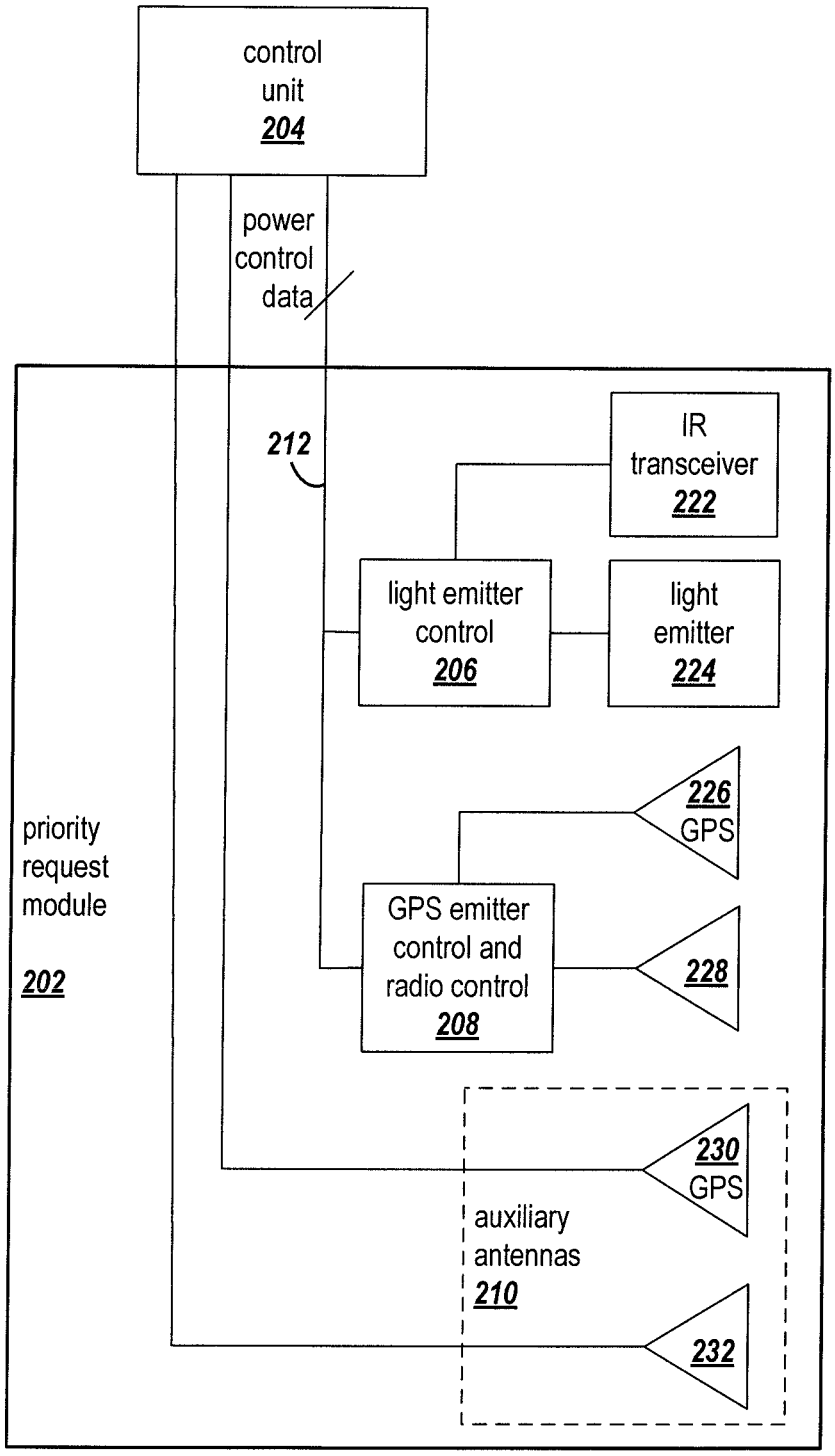
FIG. 3 illustrates a system for issuing priority requests in accordance with one or more embodiments of the invention.

FIG. 3 illustrates a system for issuing priority requests in accordance with one or more embodiments of the invention. A priority request module 202 is controlled by control unit 204. The control unit 204 is coupled to a light emitter control module 206, a GPS emitter and radio control module 208, and auxiliary antennas 210 in the priority request module.

The control unit is coupled to the light emitter control module 206 and the GPS emitter and radio control module 208 via power, control, and data lines, which are together illustrated as line 212. The data and control lines provide a shared bus through which the light emitter control module 206 and the GPS emitter and radio control module 208 can be activated and configured. For example, the light emitter control module 206 and the GPS emitter and radio control module 208 can be configured by control unit 204 with identifier codes that are transmitted in the generated priority requests. In an example implementation, the control and data lines may be implemented on a J1708 bus, which provides serial data communications between microcomputer systems in vehicle applications. Those skilled in the art will recognize that other buses could be used.

The light emitter control module 206 is coupled to an IR transceiver 222 and to a light emitter 224. The IR transceiver provides a second channel for configuring the light emitter control module 206. The light emitter includes an array of lights that are activated by the light emitter control module. The lights may be LEDs, high-intensity discharge lamps, gas discharge lamps, a future optical emission technology, or a combination thereof.

The GPS emitter control and radio control module 208 is coupled to a GPS antenna 226 and antenna 228. The GPS antenna 226 receives GPS information and provides the signal to the GPS emitter control and radio control module 208. The GPS information is transmitted by the GPS emitter control and radio control module 208 over antenna 228 in response to activation by the control unit 204.

The optional auxiliary antennas 210 include a secondary GPS antenna 230 and an auxiliary antenna 232 for other uses. The GPS antenna 230 is coupled to the control unit 204 and provides GPS information for other applications, such as an application that displays a road map and associated information for the driver of a vehicle. The auxiliary antenna 232 may be used for two-way voice communications.

Figure 4:
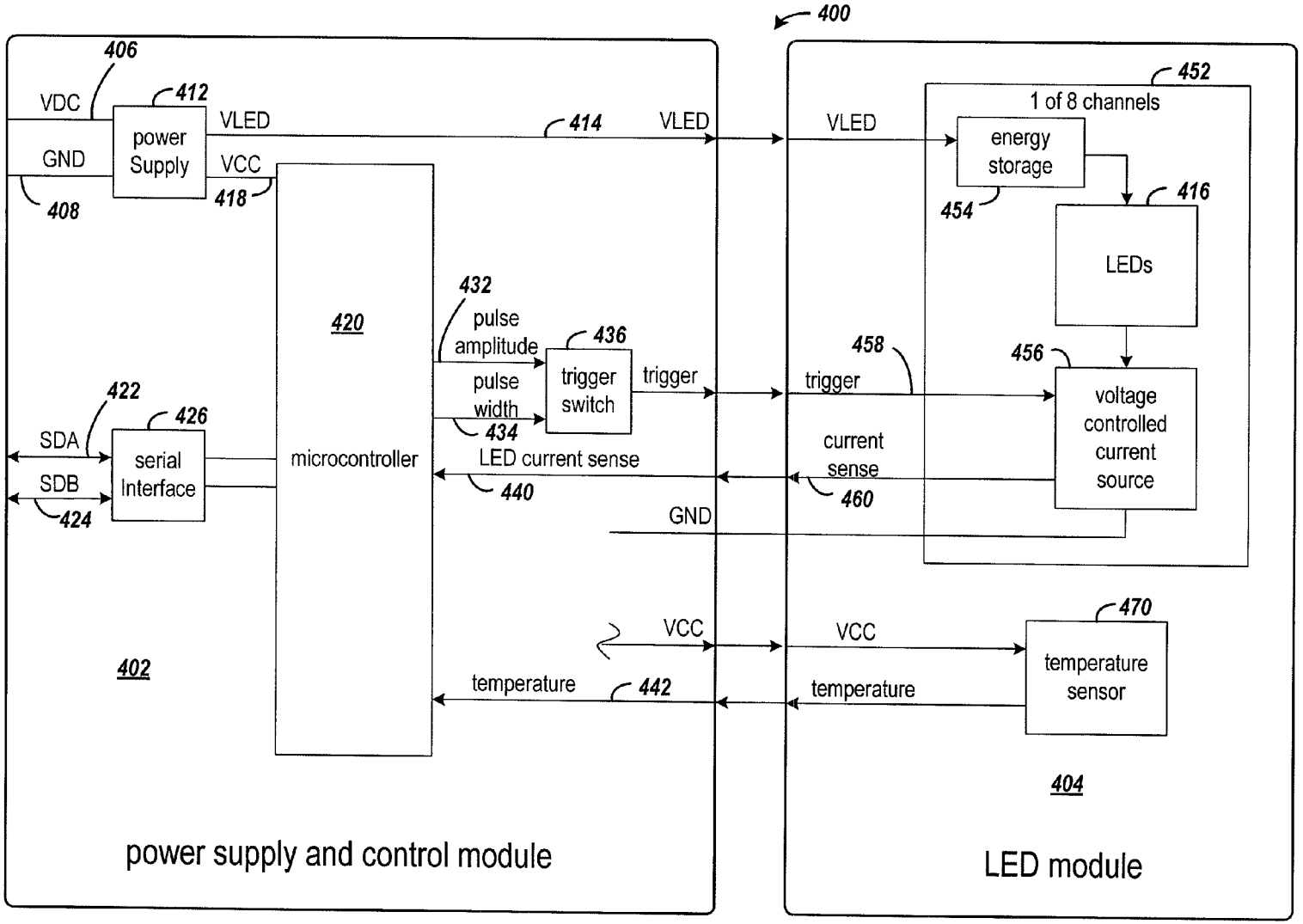
FIG. 4 shows a circuit arrangement for controlling and driving a plurality of LEDs in accordance with one or more embodiments of the invention.

FIG. 4 shows a circuit arrangement 400 for controlling and driving a plurality of LEDs in accordance with one or more embodiments of the invention. The power supply/control module is referenced as 402, and the LED array module is referenced as 404. Module 402 has a suitable connector (not shown) for coupling to vehicle power 406 and ground 408, which connection can also be used by a switch (not shown) in the vehicle to turn on and off the emitter. Those skilled in the art will recognize suitable connectors and switches for different specific implementations. Vehicle DC (or AC) is applied to power supply 412, which provides the voltage supply, VLED 414, for driving the LEDs 416, and also logic level voltage, VCC 418, for microcontroller 420. An example suitable power supply operates from an input voltage range of 10 VDC to 32 VDC. Note that for ease of explanation, each signal and the line carrying that signal are referred to by the same name and reference number. Serial connections 422 and 424 are also provided to serial interface 426 which also connects to microcontroller 420. The external serial interfaces SDA and SDB provide an interface to set an ID code that will be transmitted by the emitter. The serial interface can also be used to change the burst pulse characteristics and provides an interface to update the firmware code.

Microcontroller 420 is a programmed microprocessor which generates control signals for the burst mode and outputs pulse amplitude control 432 and pulse width control 434 to trigger switch 436. Microcontroller 420 also receives LED current sense and temperature signals 440 and 442 from the LED module 404. In an example implementation, a microcontroller such as the PIC24 16-bit microcontroller from MICROCHIP® Technology, Inc., has been found to be useful.

Power supply and control module 402 is connected to LED array module 404 by connectors suitable for the implementation. Those skilled in the art will recognize that whether the light emitter is constructed as a single unit or as multiple modules will depend on implementation-specific form factor restrictions. In an example implementation, the power supply and control module and LED modules meet the form factor restrictions of a length≤6", a height≤1.5", and a depth≤2".

The LED module 404 includes multiple channels of LEDs (e.g., 8 in one implementation). Block 452 depicts one of the multiple channels. The high voltage (for example, 40 volts) VLED 414 is coupled to an energy storage element 454 which in turn is coupled to LEDs 416. In an example embodiment, the energy storage element 454 is a capacitor, e.g., 220 μF and 50 VDC. In an example implementation, the LEDs in each channel, for example, 416, are a plurality of LEDs connected in series. A greater or smaller number may be used with corresponding changes to the voltage and power supplied. The last LED in the series is coupled to a switchable voltage controlled current source 456, such as a conventional op-amp and power transistor configuration. The trigger signal 458 is applied from trigger switch 436 to the voltage controlled current source 456, and a current sense signal 460 is fed back to microcontroller 420. In an example embodiment, the trigger switch 436 is a single pole double throw (SPDT) type analog switch with a turn-on and turn-off time of less than 50 ns and a supply voltage of 3.3 V. In response to a lack of current in a defective channel, the microcontroller 420 increases the current in the remaining operational channels to compensate for the loss of radiant power in the defective channel.

A temperature sensor 470 provides the temperature signal 442, which represents the temperature conditions within the LED module, to the microcontroller 420. An example temperature sensor suitable for use with the example microcontroller 420 is the MCP9700 sensor from MICROCHIP® Technology, Inc. In response to the temperature falling below or rising above certain thresholds, the microcontroller adjusts the pulse amplitude and pulse width to compensate for the variation of LED radiant power due to operating temperature. For example, the amplitude and/or pulse width may be varied +/−20% as the temperature approaches a low of −35 C or a high of 75 C.

The present invention is thought to be applicable to a variety of systems for controlling the flow of traffic. Other aspects and embodiments of the present invention will be apparent to those skilled in the art from consideration of the specification. It is intended that the specification and illustrated embodiments be considered as examples only, with a true scope and spirit of the invention being indicated by the following claims.

What is claimed is:

1. A priority control unit for use with light-based and GPS-based traffic control priority systems, wherein the light-based traffic control priority system activates preemption of a traffic signal in response to pulses of light encoding a priority request, and the GPS-based traffic control priority system activates preemption of a traffic signal in response to a radio signal encoding a priority request, comprising:

a light emitter subsystem configured to emit pulses of light that encode a priority request for activating preemption of a traffic signal by the light-based traffic control priority system;

a GPS-based subsystem configured to transmit a priority request by radio waves, the priority request for activating preemption of a traffic signal by the GPS-based traffic control priority system;

a shared communications bus coupled to the light emitter subsystem and to the GPS-based subsystem; and a switch coupled to the light emitter subsystem and to the GPS-based subsystem, wherein the switch simultaneously activates both the light emitter subsystem and the GPS-based subsystem for transmitting priority requests in response to user control.

2. The priority control unit of claim 1, further comprising:

a broadcast subsystem that transmits a priority request to a centralized control system; and wherein the switch is coupled to the broadcast subsystem and simultaneously activates the broadcast subsystem with the light emitter subsystem and the GPS-based subsystem.

3. The priority control unit of claim 1, wherein the light emitter subsystem and the GPS-based subsystem are configurable via the shared communications bus.

4. The priority control unit of claim 1, wherein:

the light emitter subsystem and the GPS-based subsystem are configurable with respective identifier codes via the shared communications bus; and the light emitter subsystem and the GPS-based subsystem transmit the respective identifier codes in respective priority requests.

5. The priority control unit of claim 1, further comprising:

a broadcast subsystem coupled to the shared communication bus and configured to transmit a priority request to a centralized control system;

wherein the switch is coupled to the broadcast subsystem and simultaneously activates the broadcast subsystem with the light emitter subsystem and the GPS-based subsystem.

6. The priority control unit of claim 5, wherein:

the light emitter subsystem, the GPS-based subsystem, and the broadcast subsystem are configurable with respective identifier codes via the shared communications bus; and the light emitter subsystem, the GPS-based subsystem, and the broadcast subsystem transmit the respective identifier codes in respective priority requests.

7. The priority control unit of claim 1, wherein the light emitter subsystem includes a plurality of LEDs.

8. The priority control unit of claim 7, wherein the LEDs are infrared LEDs.

9. The priority control unit of claim 7, wherein the LEDs include a plurality of visible light LEDs and a plurality of infrared LEDs.

10. The priority control unit of claim 1, wherein the light-based traffic control priority system includes a receiver with a photodetector and circuitry that produces a number of electrical pulses in response to each detected light pulse, wherein for each detected light pulse the number of electrical pulses represents a level of radiant power of the light pulse, and a threshold number of electrical pulses and an activation frequency at which the threshold number of electrical pulses is repeated activates preemption, further comprising:

wherein the light emitter subsystem includes:

a light emitter; and control circuitry coupled to the light emitter and controlling the light emitter to emit bursts of light pulses, wherein each burst includes at least two light pulses and a frequency of light pulses in each burst and a frequency of the bursts cause the receiver to produce at least the threshold number of electrical pulses at the activation frequency and activate the preemption.

11. A method for generating priority requests to light-based and GPS-based traffic control priority systems, wherein the light-based traffic control priority system activates preemption of a traffic signal in response to pulses of light encoding a priority request, and the GPS-based traffic control priority system activates preemption of a traffic signal in response to a radio signal encoding a priority request, comprising:

simultaneously activating both a light emitter subsystem and a GPS-based subsystem in response to a single user control;

emitting pulses of light by the light emitter subsystem, the pulses of light encoding a priority request for activating preemption of a traffic signal by the light-based traffic control priority system;

transmitting a priority request via radio waves by the GPS-based subsystem, the priority request for activating preemption of a traffic signal by the GPS-based traffic control priority system; and configuring the light emitter subsystem and the GPS-based subsystem via a shared communications bus that is coupled to the light emitter subsystem and to the GPS-based subsystem.

12. The method of claim 11, further comprising:

simultaneous with activating the light emitter subsystem and the GPS-based subsystem, activating a broadcast-based subsystem; and transmitting a priority request by the broadcast-based subsystem.

13. The method of claim 11, further comprising:

wherein the light emitter subsystem and the GPS-based subsystem are configurable with respective identifier codes via the shared communications bus; and transmitting the respective identifier codes in respective priority requests from the light emitter subsystem and the GPS-based subsystem.

14. A system for generating priority requests to light-based and GPS-based traffic control priority systems, wherein the light-based traffic control priority system activates preemption of a traffic signal in response to pulses of light encoding a priority request, and the GPS-based traffic control priority system activates preemption of a traffic signal in response to a radio signal encoding a priority request, comprising:

means for simultaneously activating both a light emitter subsystem and a GPS-based subsystem in response to a single user control;

means for emitting pulses of light by the light emitter subsystem, the pulses of light encoding a priority request for activating preemption of a traffic signal by the light-based traffic control priority system;

means for transmitting a priority request via radio waves by the GPS-based subsystem, the priority request for activating preemption of a traffic signal by the GPS-based traffic control priority system; and a shared communications bus coupled to the light emitter subsystem and to the GPS-based subsystem.

15. The system of claim 14, further comprising:

wherein the means for simultaneously activating both the light emitter subsystem and the GPS-based subsystem includes means for simultaneously activating a broadcast subsystem along with the light emitter subsystem and the GPS-based subsystem;

means for transmitting a priority request by the broadcast subsystem to a centralized control system.

* * * * *